United States Patent [19]

McNeil

[11] Patent Number: 4,725,252

[45] Date of Patent: Feb. 16, 1988

[54] FLOTATION DEVICE HAVING SPOTTING STREAMER

[76] Inventor: Wallace R. McNeil, 6635 Rielly Ct., Ports Richey, Fla. 34668

[21] Appl. No.: 26,394

[22] Filed: Mar. 16, 1987

[51] Int. Cl.[4] ..... B63H 21/32

[52] U.S. Cl. ..... 441/89

[58] Field of Search ..... 441/6, 11, 35, 36, 80, 441/87–101, 106–120, 129, 136

[56] References Cited

U.S. PATENT DOCUMENTS 3,095,568 6/1963 Aine et al. ..... 441/94
4,035,856 7/1977 Oberg ..... 441/89
4,551,106 11/1985 Prager ..... 441/94

FOREIGN PATENT DOCUMENTS 835116 2/1970 Canada ..... 441/96
959659 6/1964 United Kingdom ..... 441/96

*Primary Examiner*—Joseph F. Peters, Jr.
*Assistant Examiner*—Jesûs D. Sotelo
*Attorney, Agent, or Firm*—Stanley M. Miller

[57] ABSTRACT

A personal flotation device for use in emergency situations. The device includes an elongate, flotable stream member that increases the visibility of the individual wearing the device to thereby increase the probability that rescuers will visually sight the individual. The streamer member is stored in a rolled configuration in a compartment of a waist belt and is deployed when buoyancy-providing air bag members are inflated. A plurality of collapsed air bag members are stored in as many compartments of the belt, and they are inflated by gaseous fluids when ring members associated with gas-filled cartridge members are pulled by the individual at the time the water is entered.

17 Claims, 8 Drawing Figures

FLOTATION DEVICE HAVING SPOTTING STREAMER

BACKGROUND OF THE INVENTION

1. Field of the Invention

This invention relates to life-saving devices having utility in water environments, and more particularly relates to a waist belt member that contains inflatable buoyancy-providing devices and a means for enhancing the visibility of the individual using the invention.

2. Description of the Prior Art

Whenever it becomes necessary to abandon a ship or boat in deep or cold waters, a quick rescue is imperative because it is well known that the human body cannot withstand severe cold for long periods of time and that sharks inhabit both warm and cold waters.

Inventors first addressed the survival problem by providing personal flotation devices that could be donned quickly if it became necessary to enter the water; these devices came to be known generically as life jackets; some life jackets are pre-inflated and some are not.

Typically, a life jacket includes an annular waist member and an elongate tubular member that extends from a first front portion of the waist member, over the front of a first shoulder, behind the wearer's neck, over the front of a second shoulder, and back to a second front portion of the waist member.

Some inventors have advanced the art of water emergency devices by adding signaling means to life jackets; for example, the following U.S. patents show some type of signalling device used in conjunction with an individual in the water: U.S. Pat. No. 3,095,568; 3,877,096; 3,952,694 to McDonald; U.S. Pat. No. 4,035,856 and 4,551,106.

There is a need, however, for a device that combines the flotation function with means for increasing the chances that an individual in need of assistance can be spotted quickly by search and rescue personnel.

The devices known heretofore are adequate in some situations, but not all; accordingly, the art, though well-developed, is not fully developed and a need is extant for a device that combines the best flotation art with the best attention-attracting art.

Moreover, an urgent need exists for a device that can ward off sharks and other predators.

SUMMARY OF THE INVENTION

The present invention is provided in the form of a waist belt that includes four compartments of a predetermined size.

The waist belt has the general appearance of an ammunition belt; it is an elongate, flexible flat member the opposite ends of which are releasably securable to one another by post and eyelet means or other suitable fastening means.

A first compartment is positioned on the front of the belt, on a first side of the fastening means. In other words, the first compartment extends about one-fourth of the circumference of the belt, i.e., it occupies a first quadrant thereof.

A plastic air bag is stored in a collapsed configuration within the first compartment; when a first ring member is pulled, carbon dioxide is released from a first cartridge member having an outlet means in fluid communication with the interior of the bag and said bag quickly inflates. The air bag remains within its compartment at all times.

A second compartment, identical in configuration and dimension to the first, is also positioned on the front side of the belt, but on a second, opposite side of the belt's fastening means, i.e., it occupies a second quadrant thereof and has bilateral symmetry with respect to the first compartment; it also contains a gas-activated air bag that quickly inflates upon the pulling of a second ring member and which remains within its compartment at all times. A second gas-filled cartridge member is made confluent with the interior of said second air bag when said second ring member is pulled.

A third compartment has twice the extent of either of the two front compartments and is positioned on the back of the belt; accordingly, it extends unbroken across two quadrants of the belt, i.e., it describes a semicircle on the back of the belt.

An elongate tubular third air bag member is contained within the third compartment; it is filled with gas from a third gas-filled cartridge member when the aforesaid second ring member is pulled, i.e., the second ring member, when pulled, brings the second and third cartridge members into fluid communication with the interiors of the second and third air bags, respectively.

When inflated, the tubular air bag member exits said third compartment and supports the back of the head of an unconscious individual, saving said individual from drowning.

A conscious individual will insert his or her arms through the tubular member so that it fits comfortably behind the neck and in front of the shoulders.

A fourth compartment is also positioned in the back of the belt; it is coextensive with the third compartment and overlies the same, i.e., it also extends one hundred eighty degrees around the back of the individual wearing the belt.

A fourth inflatable air bag is positioned within the fourth compartment and remains therein, even when inflated; said fourth air bag is confluent with a fourth gas cartridge that is activated by pulling the first ring member, i.e., pulling the first ring member brings the first and fourth cartridge members into fluid communication with the interiors of the first and fourth air bags, respectively.

An elongate, flotable streamer member is also stored, in a rolled configuration, within the fourth compartment; it is preferably about twelve feet (12') in length, fluorescent orange in color, and provided with a plurality of longitudinally extending sinuous stripes. Like the third tubular air bag member, but unlike the first, second and fourth air bag members, said streamer member exits its compartment upon activation.

The streamer member is also provided with a plurality of air chambers which are filled with gas when the first ring member is pulled, i.e., said air chambers are brought into fluid communication with the fourth cartridge member when said first ring member is pulled.

It is therefore understood that the primary object of this invention is to save lives by providing an article that increases the probability that an individual in water will be rescued in a timely manner.

A more specific object is to provide a personal flotation device that includes a streamer member that is easy to see by rescue personnel and which deploys automatically upon the pulling of a ring member by an individual entering water in an emergency situation.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
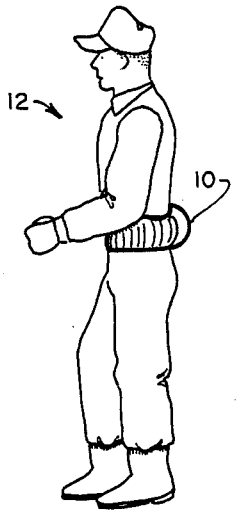
FIG. 1 shows an individual wearing the novel belt in its pre-deployment mode.

Referring now to FIG. 1, it will there be seen that the invention as a whole is denoted by the reference numeral 10; an individual 12 is shown wearing the belt in proper fashion.

Figure 2A:
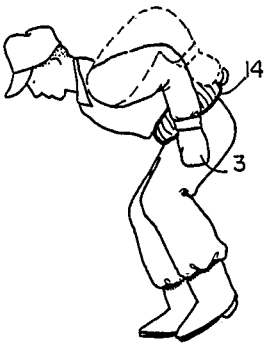
FIG. 2A shows an individual preparing to jump into water and grasping the first and second ring members of the invention preparatory to pulling them.

FIG. 2A shows the individual crouching slightly preparatory to jumping into the water; he is grasping the first and second ring members, not shown in said FIG., preparatory to pulling on them. The fourth compartment 14 can be seen in said FIG.

Figure 2B:
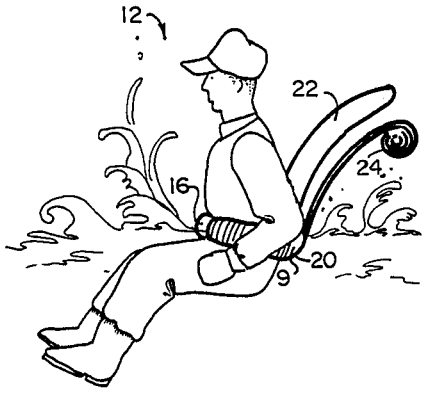
FIG. 2B shows the individual landing in the water; all four inflatable air bag members have been inflated and the novel streamer member is beginning its deployment.

In FIG. 2B, the first and second ring members have been pulled and the water has been entered; all four of the inflatable bags have been inflated and the streamer member is beginning to deploy.

More specifically, the second air bag compartment is denoted 16 in FIG. 2B, it being understood that the first air bag compartment 18 is not visible in this particular view and that the first and second air bags themselves are not depicted.

The third air bag compartment is denoted 20, the third air bag itself is denoted 22, and the streamer member is denoted 24, shown in its partially unrolled configuration.

If individual 12 were unconscious (assuming that his ring members were pulled by a third party, or that he became unconscious after pulling said ring members), the third air bag 22 would support his head above water.

The third air bag member 22, in a contemplated commercial embodiment of the invention, is an elongate tube that is about two and one-half inches (2½") in diameter when inflated. It extends in a U shape from said third compartment 20, i.e., its opposite ends remain within said third compartment 20 and its bight portion extends to about the level depicted in FIG. 2B for head-supporting purposes as aforesaid.

If the individual is conscious, upon deployment of the third air bag 22 as depicted in FIG. 2B, the individual inserts his or her arms between the opposing portions of the tube 22 by reaching backwardly, and then returns the arms to their normal position so that the bight portion of the tube 22 will abut the neck of the individual and so that opposite portions of the tube 22 are in front of the shoulders.

Figure 3:
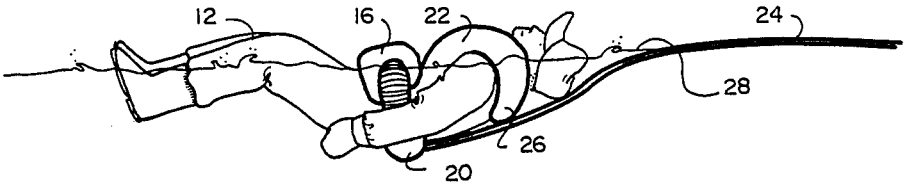
FIG. 3 shows the individual lying in the water on his back, having extended his arms through the elongate tubular member deployed from the third compartment of the belt; the streamer member is shown in its fully deployed configuration.
Figure 4:
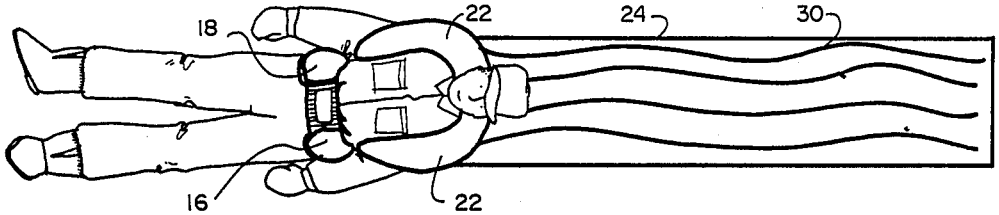
FIG. 4 is a plan view of the individual shown in FIG. 3.

The above-described positioning of the tube 22 is better understood in connection with FIGS. 3 and 4.

Bight portion 26 of tube 22 is shown to be behind the individual's neck and the individual's arms are shown to be outside said tube.

More importantly, FIG. 3 shows streamer member 24 in its fully deployed configuration; it will be noted that a major portion thereof is floating atop water 28, which position represents its operable deployment.

Streamer member 24 is more fully shown in FIG. 4. It is there seen to be a rectangular in configuration, elongate strip of flexible material, preferably plastic, having a plurality of equidistantly spaced sinusoidal markings 30 imprinted thereon. Although not shown, a similar set of longitudinally extending markings is imprinted on the underside of streamer member 24 as well.

FIG. 4 also depicts how the first and second compartment members appear when the first and second bag members therein, respectively, are inflated. It should be understood that the first, second and fourth air bag members remain positioned within their respective compartments when inflated, as aforesaid; the elongate, tubular third air bag 22 is the only air bag member that exits its associated compartment when inflated.

It should be apparent from FIG. 4 that the individual provided with the novel personal flotation device should be relatively easy to spot by rescuers positioned either on boats or aircraft.

As mentioned hereinabove, streamer member 24 is preferably provided with a fluorescent orange color or other color believed to be highly visible. It is believed that the sinusoidal strips 30 not only enhance the visibility of the streamer 24 itself, but that said markings may also have utility in warding off sharks or other predators.

Figure 5:
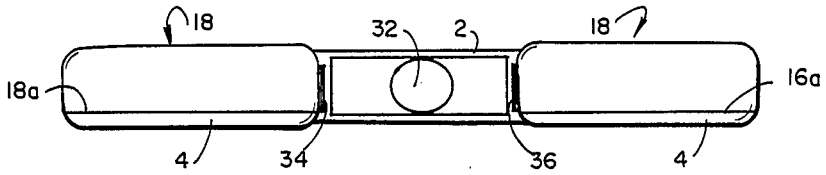
FIG. 5 is a front elevational view of the novel waist belt.
Figure 6:
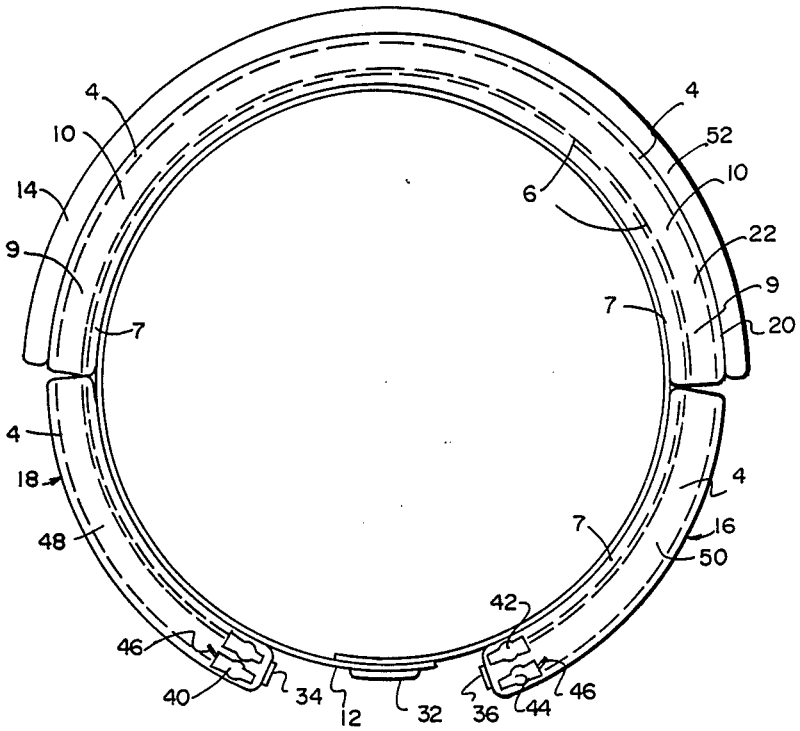
FIG. 6 is a plan view of the belt shown in FIG. 5.

The belt's fastening means 32 is also shown in FIG. 4, but reference should be made to FIGS. 5 and 6 for a more detailed view of the structure of the novel belt 10.

FIG. 5 shows the first and second ring members 34, 36 which are pulled to inflate all four of the air bag members of this invention.

FIG. 6 shows how the first ring member 34 is interconnected to the first and fourth cartridge members 38 and 40 through a pull cord means, not shown; removal of ring member 34 releases the gas in both cartridges simultaneously and inflates the first and fourth compartments 18 and 14; the second and third cartridges 42 and 44 are also simultaneously activated upon the pulling of ring member 36, thereby inflating the second compartment 16 and the elongate tubular member 22.

The preferred gas in the cartridges is carbon dioxide; each cartridge is provided with a one-way valve 46 individual to it so that gas may flow from each cartridge to its associated air bag, but not vice versa.

Reference numeral 48 denotes the air bag positioned within compartment 18; when inflated, the compartment measures about four inches by four inches (4"×4"). Compartment 18 is closed with a flap employing hook and loop fastener means; in FIG. 5, the flap for compartment 18 is denoted 18*a*.

Flap 16*a*, also provided with hook and loop fastening means, closes the second compartment 16 as shown in FIG. 5; said second compartment also inflates to a size of about four inches by four inches (4"×4"). The second air bag is denoted 50 in FIG. 6.

Similar flap members close the third and fourth compartments as well although it should be understood that, as aforesaid, the tubular member 22 exits the third compartment upon inflation, and streamer member 24 exits the fourth compartment when the fourth air bag 52 (FIG. 6) is inflated.

Alternately, the flap members that close said third and fourth compartments are not provided with hook and loop fastening means having the strength of the fastening means associated with the flap members 16*a*, 18*a*. Numerous alternative fastening means are contemplated; the flaps could be closed by means that are mechanically opened by the pulling of the ring members 34, 36, for example. Small in size and hence easily releasable hook and loop fasteners could be employed as well. Perhaps the most feasible flap closure means would be no closure means at all other than the respective flap members themselves.

Thus, the tubular member 22 and the streamer member 24 will deploy when inflated, being inherently able to displace their respective compartment-closing flap members.

The fourth air bag 52 has the same configuration and dimension as each of the first and second air bag members, i.e., it is four inches by four inches (4"×4") when inflated; like the first and second air bags, it does not exit its compartment but remains therein when streamer 24 exits therefrom.

Figure 7:
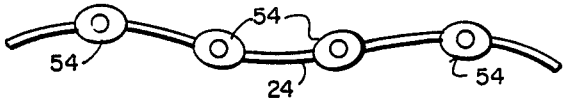
FIG. 7 is a side elevational view of the novel streamer member, showing the air chambers formed therein.

Cartridge 40 which inflates said fourth air bag 52 also inflates a plurality of small air chamber members, collectively designated 54, which are positioned at intervals along the extent of streamer member 24 as depicted in FIG. 7. This allows the streamer 24 to float in the manner depicted in FIGS. 2 and 3. Each chamber is preferably of tubular configuration and is about one inch (1") in diameter and six inches (6") in length. Of course, none of the specific dimensions disclosed herein are a part of the invention, per se.

The present invention is formed of inexpensive materials and thus is economical to produce. The air bags, e.g., may be plastic and the cartridges may be plastic as well. The belt 10 and each of the four compartments is preferably formed of canvas.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A personal flotation device, comprising:

an elongate, flexible waist belt member;

belt fastening means for releasably securing together opposite ends of said belt member;

a plurality of compartment means secured to said belt member about its periphery;

an equal-numbered plurality of inflatable buoyancy-providing means positioned in said compartment means;

a flexible streamer member stored in rolled configuration in one of said compartment means;

said streamer member extending longitudinally from its compartment means when fully discharged therefrom;

a flotation means provided as part of said streamer member for providing buoyancy to said streamer member along its extent and for causing said streamer member to exit its compartment when said flotation means is inflated;

wherein said flotation means comprises a plurality of chamber members positioned at intervals along the extent of said streamer member and further includes means for inflating said chamber members;

whereby visual sighting of an individual provided with said device is facilitated.

2. The device of claim 1, wherein said means for inflating said chamber members includes a first gas-filled cartridge member confluent with said chamber members.

3. The device of claim 2, wherein said plurality of buoyancy-providing means includes an elongate, tubular head-supporting member that projects outwardly and upwardly from its compartment means when inflated and which is positioned rearwardly of an individual's head when fully inflated, extending to said position from its compartment means and forming an inverted U when so extended such that a bight portion of said U is positioned rearwardly of said head.

4. The device of claim 3, further comprising means for rapidly inflating said head-supporting member.

5. The device of claim 4, wherein said means for rapidly inflating said head-supporting member includes a second gas-filled cartridge member.

6. A personal flotation device, comprising:

a waist belt member having a plurality of compartments members secured thereto about its periphery;

each of said compartment members having a collapsed air bag member stored therein;

each of said air bag members being confluent with a source of gaseous fluid under pressure;

an elongate, flexible streamer member stored in a rolled configuration in a preselected compartment member;

a plurality of longitudinally extending-transversely spaced sinusoidal marking means imprinted upon both sides of said streamer member;

said streamer member deploying in an unrolled configuration external to its compartment member responsive to inflation of an air bag member stored in the same compartment member with said streamer member; and, an elongate buoyancy-providing, tubular in configuration head-supporting means that is stored in a compartment member separate from the compartment member of said streamer member, said head-supporting means projecting upwardly out of its compartment member to a point rearwardly of a head of an individual wearing said belt responsive to inflation of said head-supporting means.

7. The device of claim 6, further comprising a fastening means for releasably securing to one another opposite ends of said belt member, said fastening means positioned on a front of said belt member when it is properly worn, centrally thereof.

8. The device of claim 7, wherein said plurality of compartment members and air bag members is four, wherein two of said compartment members and air bag members positioned therewithin are disposed on the front of said belt member on opposite sides of said fastening means and wherein a different two of said compartment members and air bag members positioned therewithin are disposed on a rear side of said belt member to provide stability.

9. The device of claim 8, further comprising a pair of ring members graspable by an individual wearing said belt member, each of said ring members being associated with two different cartridge members and operable when pulled to release gas under pressure into associated air bag members.

10. A personal flotation device, comprising:

a waist belt member having four compartment members fixedly secured to its periphery;

an air bag member positioned in collapsed configuration interiorly of each of said compartment members;

each of said air bag members having an interior closed to fluid communication with a gas-filled cartridge member by a closure means associated with each of said cartridge members;

a pair of ring members graspable by an individual wearing said belt member that when pulled remove said closure means and bring the respective interiors of said air bag members into fluid communication with said cartridge members to rapidly inflate said air bag members;

a one-way valve means positioned between each of said air bag members and said cartridge members to allow flow of gas under pressure into but not out of said air bag members;

one of said air bag members being provided in the form of an elongate tubular member that projects outwardly of its compartment member and extends to a location rearwardly of a head of an individual wearing said belt member to support said head if needed;

and a different one of said compartment members containing an elongate, flexible streamer member stored therein in a rolled configuration, said streamer member being deployable and unrollable from its compartment member responsive to inflation of the air bag member common to said compartment member with said streamer member.

11. The device of claim 10, wherein said streamer member is provided with flotation means.

12. The device of claim 11, wherein said flotation means includes a plurality of air chamber members formed in said streamer member along its extent.

13. The device of claim 12, wherein said air chamber members are filled with gas from a preselected cartridge member when a preselected ring member is pulled.

14. The device of claim 13, wherein said streamer member has a plurality of elongate, longitudinally extending sinusoidal markings imprinted on both sides thereof.

15. The device of claim 14, wherein the compartment member containing said flexible streamer member is closed with an easy-opening flap means.

16. The device of claim 15, wherein the compartment member containing said tubular air bag member is closed with an easy-opening flap means.

17. The device of claim 16, wherein the compartment members other than the compartment members which contain said streamer member and said tubular member are closed by closure means that do not open when their respective air bag members are inflated.

* * * * *